US011555402B2

(12) United States Patent
Jones et al.

(10) Patent No.: US 11,555,402 B2
(45) Date of Patent: Jan. 17, 2023

(54) SPLIT FLOW PROBE FOR REACTIVE RESERVOIR SAMPLING

(71) Applicant: Halliburton Energy Services, Inc., Houston, TX (US)

(72) Inventors: Christopher Michael Jones, Katy, TX (US); Anthony Herman van Zuilekom, Houston, TX (US); Darren George Gascooke, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 123 days.

(21) Appl. No.: 17/119,281

(22) Filed: Dec. 11, 2020

(65) Prior Publication Data

US 2021/0246785 A1 Aug. 12, 2021

Related U.S. Application Data

(60) Provisional application No. 62/972,171, filed on Feb. 10, 2020.

(51) Int. Cl.

| | |
|---|---|
| ***E21B 49/08*** | (2006.01) |
| ***E21B 33/12*** | (2006.01) |
| ***E21B 34/08*** | (2006.01) |

(52) U.S. Cl.

CPC ..... *E21B 49/0875* (2020.05); *E21B 33/12* (2013.01); *E21B 34/08* (2013.01); *E21B 49/081* (2013.01); *E21B 49/082* (2013.01)

(58) Field of Classification Search

CPC ..... E21B 33/12; E21B 34/08; E21B 49/081; E21B 49/082; E21B 49/08; E21B 49/087; E21B 49/10

See application file for complete search history.

(56) References Cited

U.S. PATENT DOCUMENTS 2,511,759 A * 6/1950 Philips ..... E21B 49/082 166/66.4
5,230,244 A * 7/1993 Gilbert ..... E21B 49/10 73/152.17

(Continued)

FOREIGN PATENT DOCUMENTS

EP 2044289 B1 2/2011
WO 2018165095 A1 9/2018

OTHER PUBLICATIONS

PCT Application Serial No. PCT/US2020/064811; ISR; Apr. 1, 2021, 3 pages.

(Continued)

*Primary Examiner* — Steven A MacDonald
(74) *Attorney, Agent, or Firm* — Delizio, Peacock, Lewin & Guerra

(57) ABSTRACT

A downhole tool comprises at least one inlet and a first pump coupled to the at least one inlet via a first flow line. The first pump is to pump at a first pump rate to extract fluid via the at least one inlet from a subsurface formation in which a borehole is created and in which the downhole tool is to be positioned. A sample chamber is coupled to the inlet via a second flow line, and a second pump is coupled to the inlet via the second flow line. The second pump is to pump at a second pump rate to extract the fluid via the at least one inlet from the subsurface formation and for storage in the sample chamber. The first pump rate is greater than the second pump rate.

11 Claims, 9 Drawing Sheets

(56) References Cited

U.S. PATENT DOCUMENTS 6,047,239 A * 4/2000 Berger ..... E21B 49/088 702/9
6,301,959 B1 * 10/2001 Hrametz ..... E21B 49/10 73/152.01
6,939,717 B2 7/2005 Jiang et al.
7,025,138 B2 4/2006 Krukjian et al.
7,886,825 B2 2/2011 Van Hal et al.
8,057,752 B2 11/2011 Torgersen et al.
8,379,207 B2 2/2013 Difoggio et al.
8,805,614 B2 8/2014 Andrews et al.
8,985,218 B2 * 3/2015 Bedouet ..... E21B 49/08 166/336
9,115,567 B2 * 8/2015 Hsu ..... E21B 47/008
9,291,585 B2 3/2016 Singh et al.
9,546,959 B2 1/2017 Indo et al.
9,631,489 B2 * 4/2017 Irani ..... E21B 49/10
9,664,665 B2 5/2017 Gisolf et al.
10,012,633 B2 7/2018 Gisolf et al.
11,306,584 B2 * 4/2022 Al Dawood ..... E21B 49/10
2001/0050170 A1 * 12/2001 Woie ..... E21B 49/008 166/250.07
2004/0045350 A1 * 3/2004 Jones ..... G01N 27/44791 73/152.23
2004/0139798 A1 * 7/2004 Haddad ..... G01N 11/08 73/152.18
2004/0231408 A1 * 11/2004 Shammai ..... E21B 49/10 73/705
2007/0214877 A1 9/2007 Shammai
2008/0066536 A1 * 3/2008 Goodwin ..... E21B 49/10 73/152.24
2008/0173445 A1 * 7/2008 Dong ..... E21B 47/113 166/264
2008/0223125 A1 * 9/2008 Meister ..... E21B 49/10 73/152.26
2009/0101339 A1 * 4/2009 Zazovsky ..... E21B 49/10 73/152.28
2009/0183882 A1 * 7/2009 van Zuilekom ..... E21B 49/081 166/371
2010/0000728 A1 * 1/2010 O'Keefe ..... E21B 49/082 166/173
2010/0132940 A1 * 6/2010 Proett ..... E21B 49/10 166/250.17
2010/0175873 A1 * 7/2010 Milkovisch ..... E21B 49/081 166/264
2012/0279702 A1 * 11/2012 Bedouet ..... E21B 49/08 166/250.03
2013/0133885 A1 * 5/2013 Habib ..... E21B 49/084 166/162
2014/0166269 A1 * 6/2014 Pop ..... E21B 49/10 73/152.28
2014/0224474 A1 * 8/2014 Cernosek ..... E21B 49/081 166/107
2014/0345860 A1 * 11/2014 Van Zuilekom ..... E21B 49/084 166/69
2015/0021020 A1 1/2015 Whittaker et al.
2015/0337656 A1 * 11/2015 Irani ..... E21B 49/10 166/264
2016/0130927 A1 * 5/2016 Waid ..... E21B 43/121 166/185
2016/0168990 A1 * 6/2016 van Hal ..... G01N 33/2823 73/23.35
2016/0177714 A1 * 6/2016 Tao ..... F04B 53/14 166/66
2016/0258279 A1 * 9/2016 Xia ..... G01V 9/005
2017/0022809 A1 * 1/2017 Garcia ..... E21B 49/10
2018/0171788 A1 * 6/2018 Waid ..... E21B 49/088
2018/0340418 A1 * 11/2018 Perkins ..... E21B 47/10
2019/0106987 A1 * 4/2019 Kristensen ..... E21B 49/088
2019/0234211 A1 * 8/2019 Reding ..... E21B 49/10
2019/0284919 A1 * 9/2019 Jones ..... E21B 49/082
2021/0388721 A1 * 12/2021 Hsu ..... G01N 21/8507

OTHER PUBLICATIONS

PCT Application Serial No. PCT/US2020/064811; Written Opinion; dated Apr. 1, 2021, 6 pages.

* cited by examiner

FIG. 1A
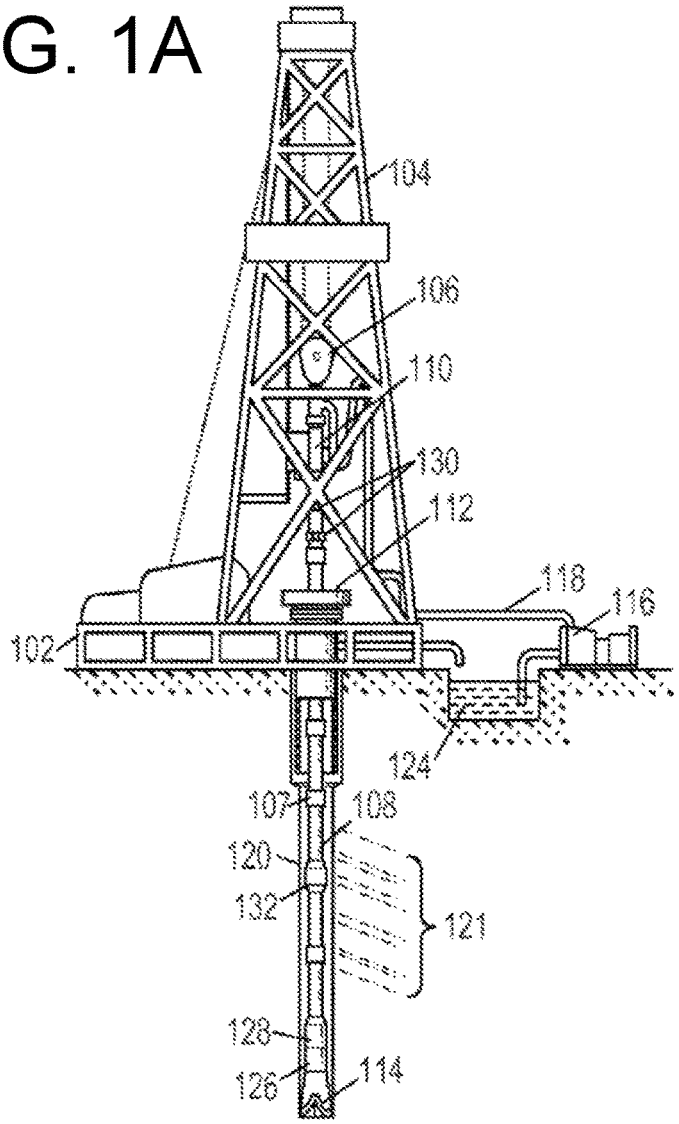
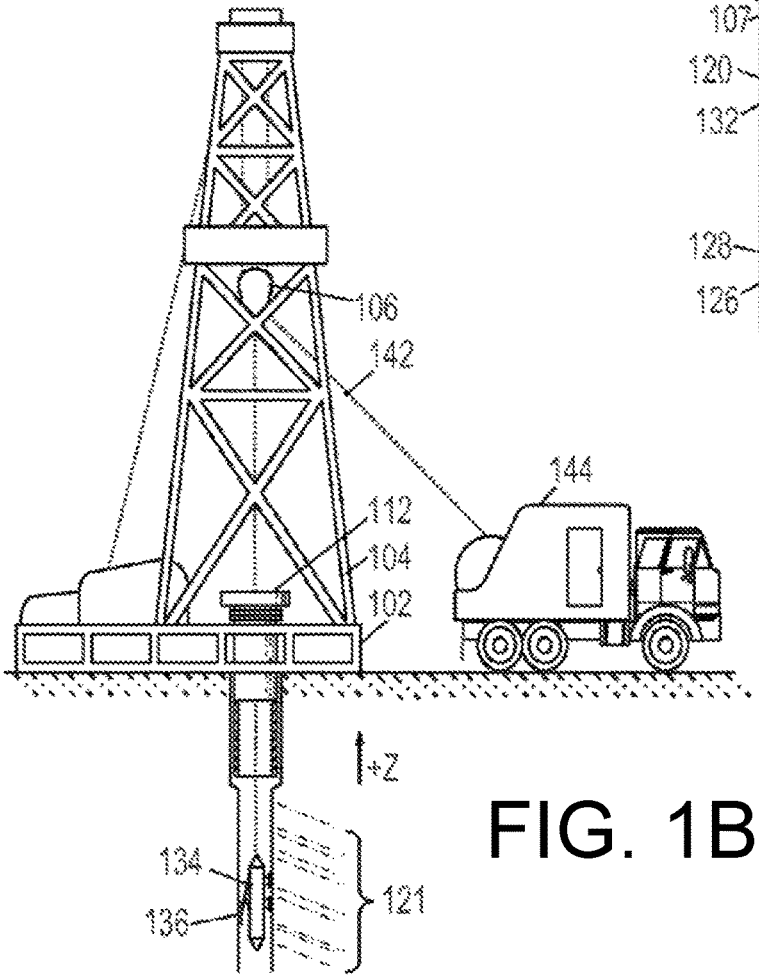
FIG. 1B

SPLIT FLOW PROBE FOR REACTIVE RESERVOIR SAMPLING

BACKGROUND

The disclosure generally relates to fluid sampling from a subsurface reservoir, and more particularly to a split flow probe for sampling a reactive downhole reservoir.

Hydrocarbons, such as oil and gas, are commonly obtained from subterranean formations. The development of subterranean operations and the processes involved in removing hydrocarbons from a subterranean formation are complex. Typically, subterranean operations involve a number of different steps such as, for example, drilling the wellbore at a desired well site, treating the wellbore to optimize production of hydrocarbons, and performing the necessary steps to produce and process the hydrocarbons from the subterranean formation.

In order to optimize the performance of hydrocarbon recovery operations, it can be advantageous to determine various formation characteristics such as, for example, pressure and/or permeability. A formation tester can be used to determine formation characteristics. The formation tester is typically lowered into a borehole traversing a formation of interest. A probe of the formation tester, generally composing either a pad or packer, may then be extended and sealingly placed in fluid communication with the formation of interest. Formation fluid may then be drawn by the formation tester, and various analysis can be performed on such fluid.

BRIEF DESCRIPTION OF THE DRAWINGS

Embodiments of the disclosure may be better understood by referencing the accompanying drawings.

FIG. 1A depicts an illustrative logging while drilling (LWD) system, according to some embodiments.

FIG. 1B depicts an illustrative wireline system, according to some embodiments.

DESCRIPTION

Figure 2:
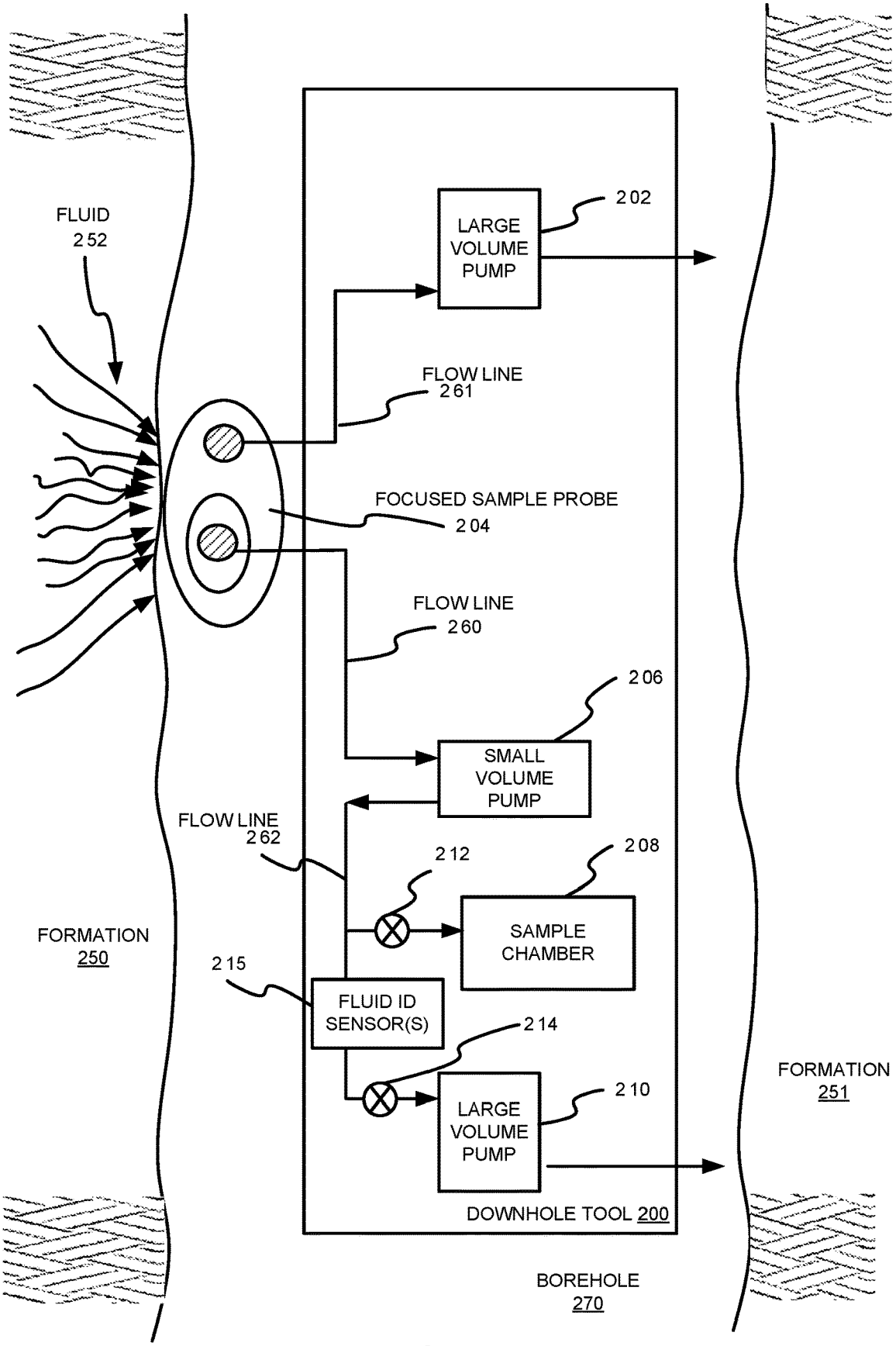
FIG. 2 depicts an illustrative downhole tool that includes a split flow focused probe for sampling a reactive reservoir, according to some embodiments.

The description that follows includes example systems, methods, techniques, and program flows that embody aspects of the disclosure. However, it is understood that this disclosure may be practiced without these specific details. For instance, this disclosure refers to an inlet (e.g., a probe), which may be of multiple pad or packer designs, to extract fluids from a formation in illustrative examples. Aspects of this disclosure can also use any type of inlet that can include one or more inlets. In other instances, well-known instruction instances, protocols, structures and techniques have not been shown in detail in order not to obfuscate the description.

Various embodiments relate to a downhole tool for formation sampling ("formation samplers"). Such a tool can include a probe to extract fluid from the surrounding subsurface formation. This extracted fluid can be analyzed to determine various formation characteristics. Some embodiments incorporate a split flow configuration or common flow line from that probe. In a split flow configuration, a first flow can be used to clean the reservoir from drilling fluid filtrate at a rapid rate with a large volume pump, while a second flow can be used to sample the formation fluids (having reactive components) with a small volume pump. Additionally, the probe may be either focused or unfocused.

Conventional formation samplers generally use a small low-volume pump to sample the formation fluid to determine levels or concentrations of reactive components (e.g., hydrogen sulfide, mercury, acid, etc.). Using such a configuration that is extracting the fluid at a low flow rate with a small volume pump can require a lengthy time period to remove drilling fluid filtrate from the formation. However, removal of drilling fluid filtrate needs to happen prior to sampling formation fluid (including any reactive components therein). Also, during the sampling to capture reactive components, the amount of surface area in the formation sampler to which the reactive components are exposed should be minimized. Otherwise, the reactive components can react to these surface areas thereby reducing the level of reactive components in the fluid. Therefore, exposure to significant surface area in the formation sampler prior to storage in a sample chamber can result in inaccuracies in the level of reactive components in the fluid. Unfortunately, the larger the volume size of the pump the greater the surface area to which the reactive components can be exposed. Accordingly, a low-volume pump can be desirable to minimize the surface area in contact with the fluid sample prior to capture in a sample chamber. However, using a small volume pump for cleanup to remove the drilling fluid filtrate can be very slow. Further, the steady state level of contamination which may be achieved with small pumps may be higher than the steady state level of contamination which may be achieved with large pumps.

Example embodiments can split the flow from a probe into more than one direction. One direction of the flow can be powered by a high-volume (fast) pump in order to clean the formation at a rapid rate. A second direction of the flow can be powered by a low-volume (slow) pump in order to minimize tool surface area in contact with the fluid to be sampled during sampling of the formation fluid. While using such embodiments, a sample can be acquired more quickly. Using such embodiments can also lower mud contamination of the reactive component concentration being captured. Thus, a more representative concentration of reactive components in the fluid may be acquired.

Example embodiments include a split-flow probe with multiple pumps of varying volumes. For example, example embodiments can include at least two pumps. A first flow can be considered a minimum configuration path—which includes a small low-volume pump that draws fluid from a probe through a first flow line. Such fluid can be diverted into a sample chamber.

A second flow can be powered by a high-volume faster pump. A high-volume pump can result in a larger surface area in comparison to the minimum configuration path of the first flow. However, since surface area is not a concern with the second flow, the path of the second flow may include a larger set of tool string subsections thereby providing greater formation testing capability along this second path. The second path may, for instance, include additional flow line tools such as fluid identification (ID) tool subsections before or after the large volume pump. In yet other embodiments, more than one probe may be co-located as to withdraw fluid from the formation according to the same pump-out volume of the formation. Such near co-located probes may be concentric or simply juxtaposed. Examples of such probes are described below in reference to FIGS. 2-6. An example of using a packer configuration for split flow is described below in reference to FIG. 7. Thus, both flows or paths pull fluid from the same formation probe or packer element. The second path flow rate may be much larger than that of the first path and thereby provide a much faster formation pump out time to cleanup. The larger and smaller surface area flow paths may be partially along the same path. In some embodiments, with the use of multiple probes, the probe or probe portion centermost to the formation flow can be selected for the smaller surface area path for fluid sampling. In some embodiments, the pump type does not have to be of the same type. For instance, a large volume double cylinder pump may be paired with a less efficient single volume pump in order to trade efficiency for surface area. In such an embodiment, the less efficient lower volume pump can be used for filling the sample chambers. Also, while the examples depicted in FIGS. 2-7 depict the probes or pads in vertical alignment, these probes or pads can also be radially distributed, horizontally distributed, and/or vertically distributed.

Example Systems

FIG. 1A depicts an illustrative logging while drilling (LWD) system, according to some embodiments. A drilling platform 102 supports a derrick 104 having a traveling block 106 for raising and lowering a drill string 108. A top drive 110 supports and rotates the drill string 108 as the string is lowered through a well head 112. The drill string's rotation (and/or a downhole motor) drives a drill bit 114 to extend the borehole through subsurface earth formations 121. Mud recirculation equipment 116 draws drilling fluid from a retention pit 124 and pumps it through a feed pipe 118 to top drive 110, through the interior of drill string 108 to the drill bit 114, through orifices in drill bit, through the annulus around drill string 108 to a blowout preventer at the surface, and through a discharge pipe into the pit 124. The drilling fluid transports cuttings from the borehole into the pit 124 and aids in maintaining the borehole integrity.

One or more logging tools 126 are integrated into a bottomhole assembly 180 near the bit 114. Suitable logging tools include formation fluid sampling tools, acoustic logging tools, electromagnetic resistivity tools, and nuclear magnetic resonance tools, among others. Logging while drilling tools usually take the form of a drill collar, i.e., a thick-walled tubular that provides weight and rigidity to aid the drilling process. As the bit extends the borehole through the formations, the logging tool(s) collect measurements of formation characteristics. Other tools and sensors can also be included in the bottomhole assembly 180 to gather measurements of various drilling parameters such as position, orientation, weight-on-bit, borehole diameter, etc. Control/telemetry module 128 collects data from the various bottomhole assembly instruments (including position and orientation information) and stores them in internal memory. Selected portions of the data can be communicated to surface receivers 130 by, e.g., mud pulse telemetry. Other logging-while drilling telemetry methods also exist and could be employed. For example, electromagnetic telemetry or through-wall acoustic telemetry can be employed with an optional repeater 132 to extend the telemetry range. As another example, the drill string 108 could be formed from wired drillpipe that enables waveforms or images to be transmitted to the surface in real time to enable quality control and processing to optimize the logging resolution. Most telemetry systems also enable commands to be communicated from the surface to the control and telemetry module to configure the operation of the tools.

At various times during the drilling process, the drill string 108 may be removed from the borehole for wireline logging operations. For example, FIG. 1B depicts an illustrative wireline system, according to some embodiments. Once the drill string has been removed, logging operations can be conducted using a logging tool 134. The logging tool 134 may be suspended by a conveyance 142. Conveyance 142 may include any suitable means for providing mechanical conveyance for logging tool 134, including, but not limited to, wireline, slickline, coiled tubing, pipe, drill pipe, downhole tractor, or the like. In some embodiments, conveyance 142 may provide mechanical suspension, as well as electrical connectivity, for the logging tool 134. Conveyance 142 may comprise, in some instances, a plurality of electrical conductors extending from a vehicle located at the surface. The conveyance 142 may or may not have conductors for transporting power to the tool and telemetry from the tool to the surface. The logging tool 134 may have pads 136 and/or centralizing springs to maintain the tool near the axis of the borehole. A logging facility 144 collects measurements from the logging tool 134 and includes a computer system for processing and storing the measurements gathered by the logging tool 134. The logging tools 126 of FIG. 1A or the tool 134 of FIG. 1B can include a split flow probe for sampling a reactive downhole reservoir (as described herein).

Example Downhole Tools

FIG. 2 depicts an illustrative downhole tool that includes a split flow focused probe for sampling a reactive reservoir, according to some embodiments. FIG. 2 depicts a downhole tool 200 positioned in a borehole 270 with surrounding formations 250-251.

The downhole tool 200 includes a focused sample probe 204, a large volume pump 202, flow lines 260-262, a small volume pump 206, a sample chamber 208, fluid identification (ID) sensor(s) 215, a large volume pump 210, and valves 212-214. The focused sample probe 204 is positioned near or adjacent to the surrounding formation 250 such that fluid 252 is extracted from the surrounding formation 250 through the focused sample probe 204. A non-focused inlet of the focused sample probe 204 is coupled to an input of the large volume pump 202 through the flow line 261. An output of the large volume pump 202 is coupled to output fluid into the borehole 270.

A focused inlet of the focused sample probe 204 is coupled to an input of the small volume pump 206 through the flow line 262. An output of the small volume pump is coupled to an input of the valve 212. An output of the valve 212 is coupled to an input of the sample chamber 208. An output of the small volume pump 206 is also coupled to an input of the fluid ID sensor(s) 215. An output of the fluid ID sensor(s) 215 is coupled to an input of the valve 214. An output of the valve 214 is coupled to an input of the large volume pump 210. An output of the large volume pump 210 is coupled to output fluid into the borehole 270.

In some embodiments, a small volume pump can be a pump having a pump rate less than 1.0 cubic centimeter (cc)/second (sec), less than 1.5 cc/sec, less than 2.0 cc/sec, 4.0 cc/sec, 8.0 cc/sec, etc. In some embodiments, a large volume pump can be a pump having a flow rate greater than 10 cc/sec, 20 cc/sec, 40 cc/sec, greater than 50 cc/sec, greater than 60 cc/sec, greater than 70 cc/sec, greater than 80 cc/sec, etc.

Additionally, a distance from the probe to the small volume pump is less than a distance from the probe to the large volume pump. Reducing this distance can further reduce the surface area of the tool to which the fluid is exposed prior to storage in the sample chamber. In some embodiments, a diameter of the flow line from the probe to the small volume pump and to the sample changer is smaller than the diameter of the flow line to the large volume pump.

A minimum configuration path from the focused sample probe 204 to the sample chamber 208 may be coated with a reactive component inert coating or be constructed from a reactive component inert material. Such materials can include MP35N (nickel-cobalt base alloy) for hydrogen sulfide (H2S). Such coatings can include aluminum oxide (Al2O3) for H2S or Al2O3 or Tech12 (thin film ceramic) for mercury. The sample chamber 208 may also be coated with a reactive component inert material or may be constructed from a reactive component material as appropriate for the reactive component. Additionally, the small volume pump 206 may be coated or constructed from an inert material. Further, the small volume pump 206 may operate with a hydraulic material inert to H2S (such as a CF60 material (composite of 60% woven carbon fiber laminated with a polyaryl ether ketone resin (PAEK)). The buffer fluid in the sample chamber 208 may include a reactive material inert fluid such as CF60 or may include a material that captures and preserves the reactive component such as aqueous amines for H2S.

While depicted as a focused probe, the probe may either be a focused probe or an unfocussed probe. If a focused probe is used, fluid for the minimum configuration path can be drawn from the center probe as opposed to the outer guard probe. If a packer is used (instead of a probe), fluid for the minimum configuration path can be from the upper port assuming that the density of the formation fluid is less than that of the drilling fluid filtrate. However, if the formation fluid is of greater density than that of the drilling fluid filtrate, fluid for the minimum configuration path can be from the bottom port of a packer. If the probe is unfocused, fluid for the minimum configuration path can be from a more centralized position of the probe then from the edges.

In some embodiments, fluid would be withdrawn from the large volume pump while maintaining the fluid above the bubble point of the formation fluid. The fluid can be pulled from a guard side of a focused sampling probe. Fluid composition along the guard side can be monitored for contamination. Fluid from the larger surface area configuration path may be slowed down during sampling from the minimum configuration path in order to balance rates. The minimum configuration path can be operated during the course of the entire pump out in order to better passivate any exposed reactive surfaces along the minimum configuration path. The minimum configuration path operational speed may be changed from zero to maximum speed in order to pulse the commingled fluid properties in the guard side. This may be performed in order to better determine the fluid properties in order to in part inform a sampling decision.

Other example downhole tools are now described having other types of probes for providing for split flow are now described in reference to FIGS. 3-6.

Figure 3:
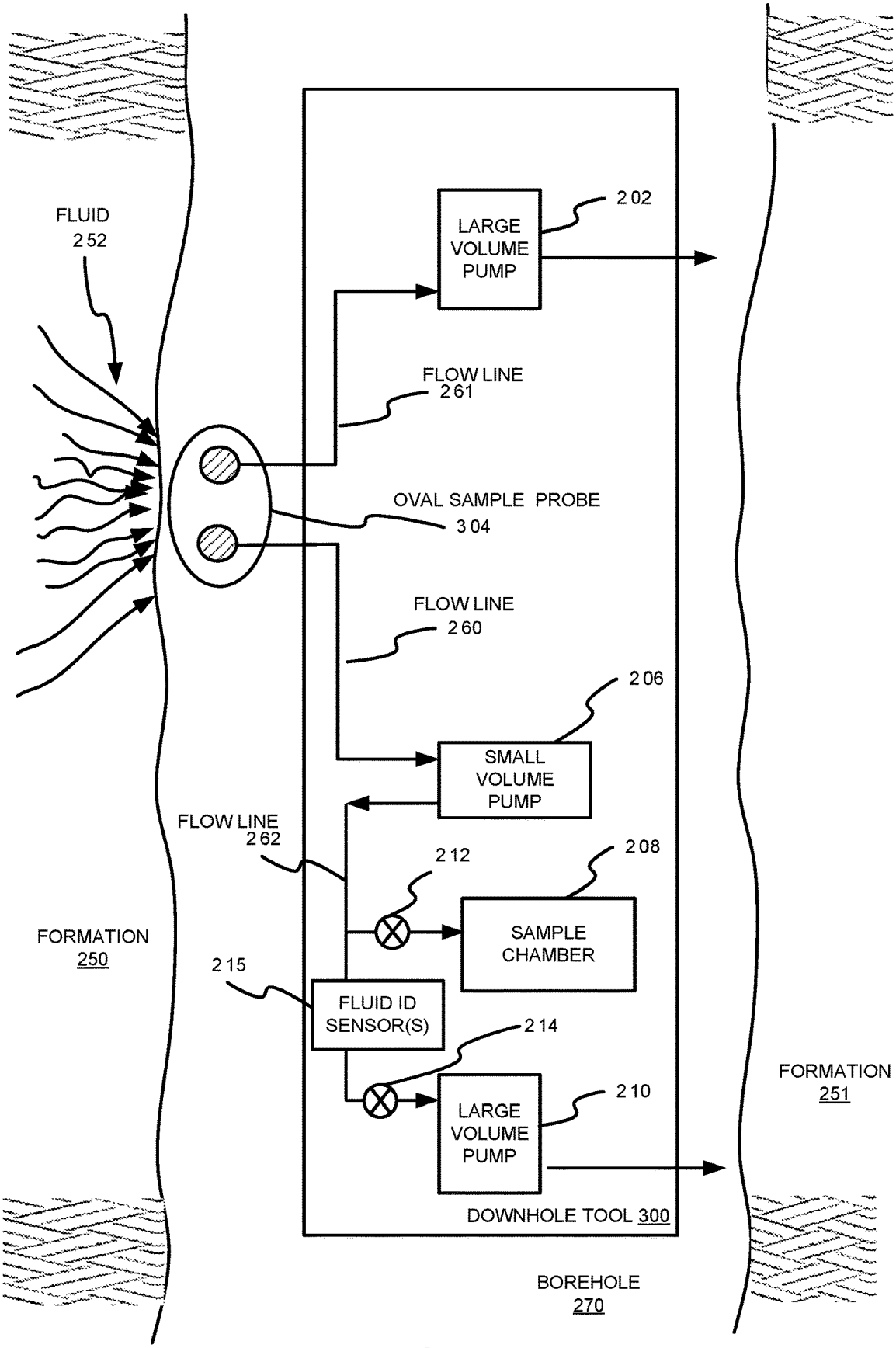
FIG. 3 depicts an illustrative downhole tool that includes a first example split flow oval probe for sampling a reactive reservoir, according to some embodiments.

FIG. 3 depicts an illustrative downhole tool that includes a first example split flow oval probe for sampling a reactive reservoir, according to some embodiments. The downhole tool of FIG. 3 is similar to the downhole tool of FIG. 2 but includes an oval sample probe that is coupled to the flow lines of the downhole tool. As shown, FIG. 3 includes a downhole tool 300 having an oval sample probe 304. A first inlet of the oval sample probe 304 is coupled to the flow line 261. A second inlet of the oval sample probe 304 is coupled to the flow line 260. While having a different probe configuration, operations of the downhole tool 300 are similar to operations of the downhole tool 200 of FIG. 2 to provide the split flow.

Figure 4:
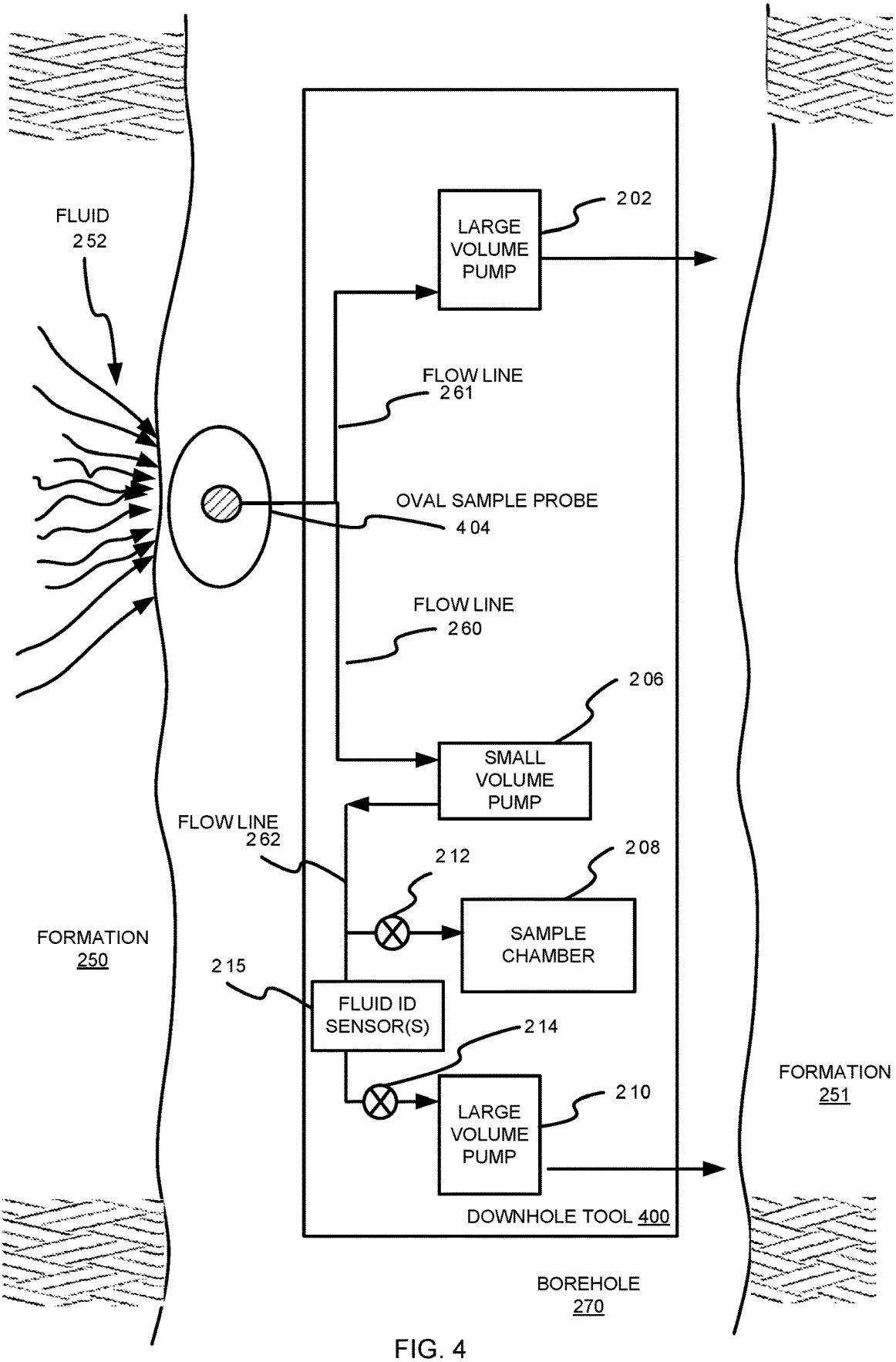
FIG. 4 depicts an illustrative downhole tool that includes a second example split flow oval probe for sampling a reactive reservoir, according to some embodiments.

FIG. 4 depicts an illustrative downhole tool that includes a second example split flow oval probe for sampling a reactive reservoir, according to some embodiments. The downhole tool of FIG. 4 is similar to the downhole tool of FIG. 2 but includes an oval sample probe that is coupled to the flow lines of the downhole tool. As shown, FIG. 4 includes a downhole tool 400 having an oval sample probe 404. An inlet of the oval sample probe 404 is coupled to the flow line 261 and the flow line 260. While having a different probe configuration, operations of the downhole tool 400 are similar to operations of the downhole tool 200 of FIG. 2 to provide the split flow.

Figure 5:
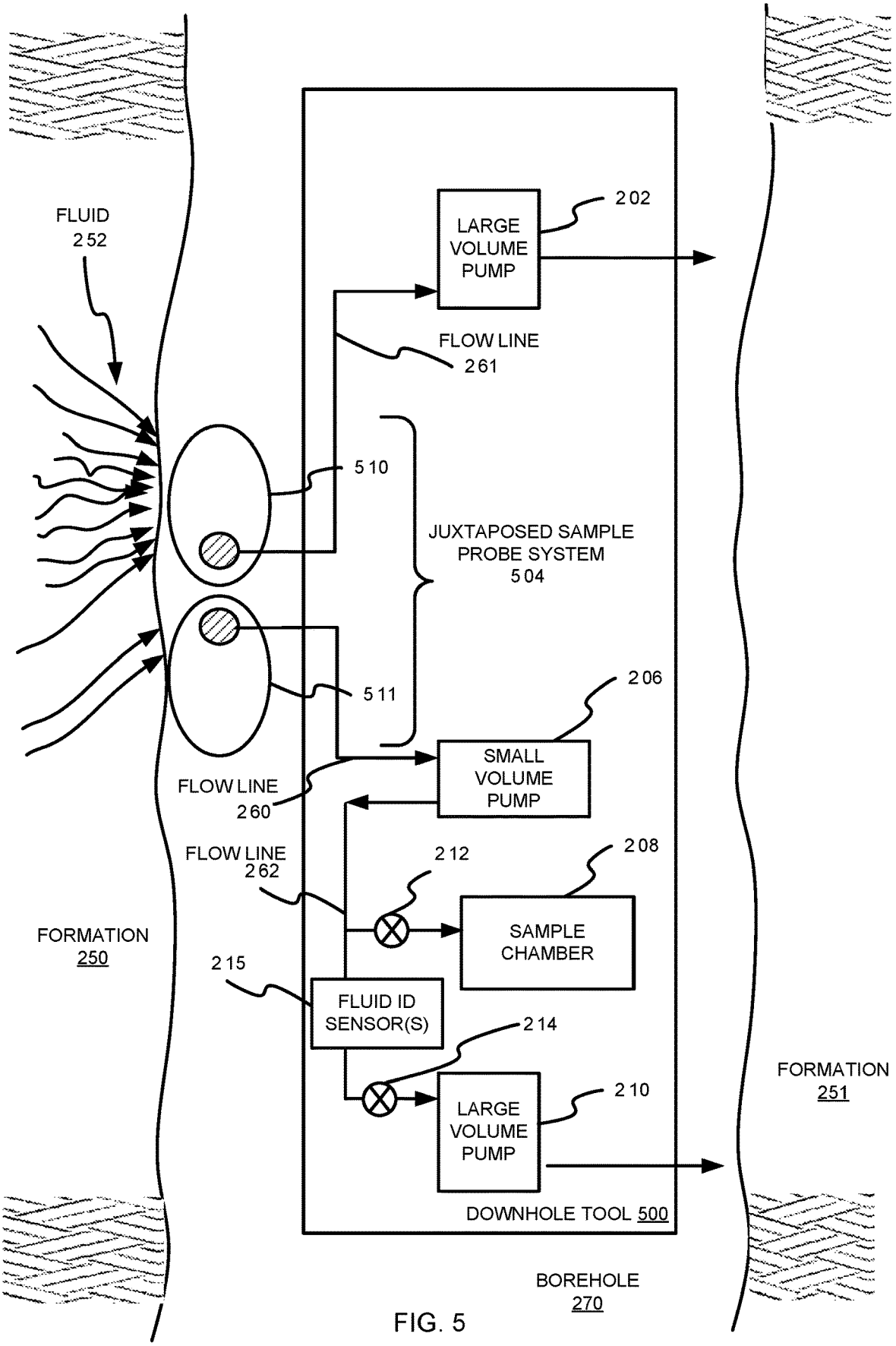
FIG. 5 depicts an illustrative downhole tool that includes a split flow juxtaposed probe system having two probes for sampling a reactive reservoir, according to some embodiments.

FIG. 5 depicts an illustrative downhole tool that includes a split flow juxtaposed probe system having two probes for sampling a reactive reservoir, according to some embodiments. The downhole tool of FIG. 5 is similar to the downhole tool of FIG. 2 but includes a juxtaposed probe system having two probes that is coupled to the flow lines of the downhole tool. As shown, FIG. 5 includes a downhole tool 500 having a juxtaposed probe system 504 that includes a probe 510 and a probe 511. An inlet of the probe 510 is coupled to the flow line 261. An inlet of the probe 5100 is coupled to the flow line 260. While having a different probe configuration, operations of the downhole tool 500 are similar to operations of the downhole tool 200 of FIG. 2 to provide the split flow.

Figure 6:
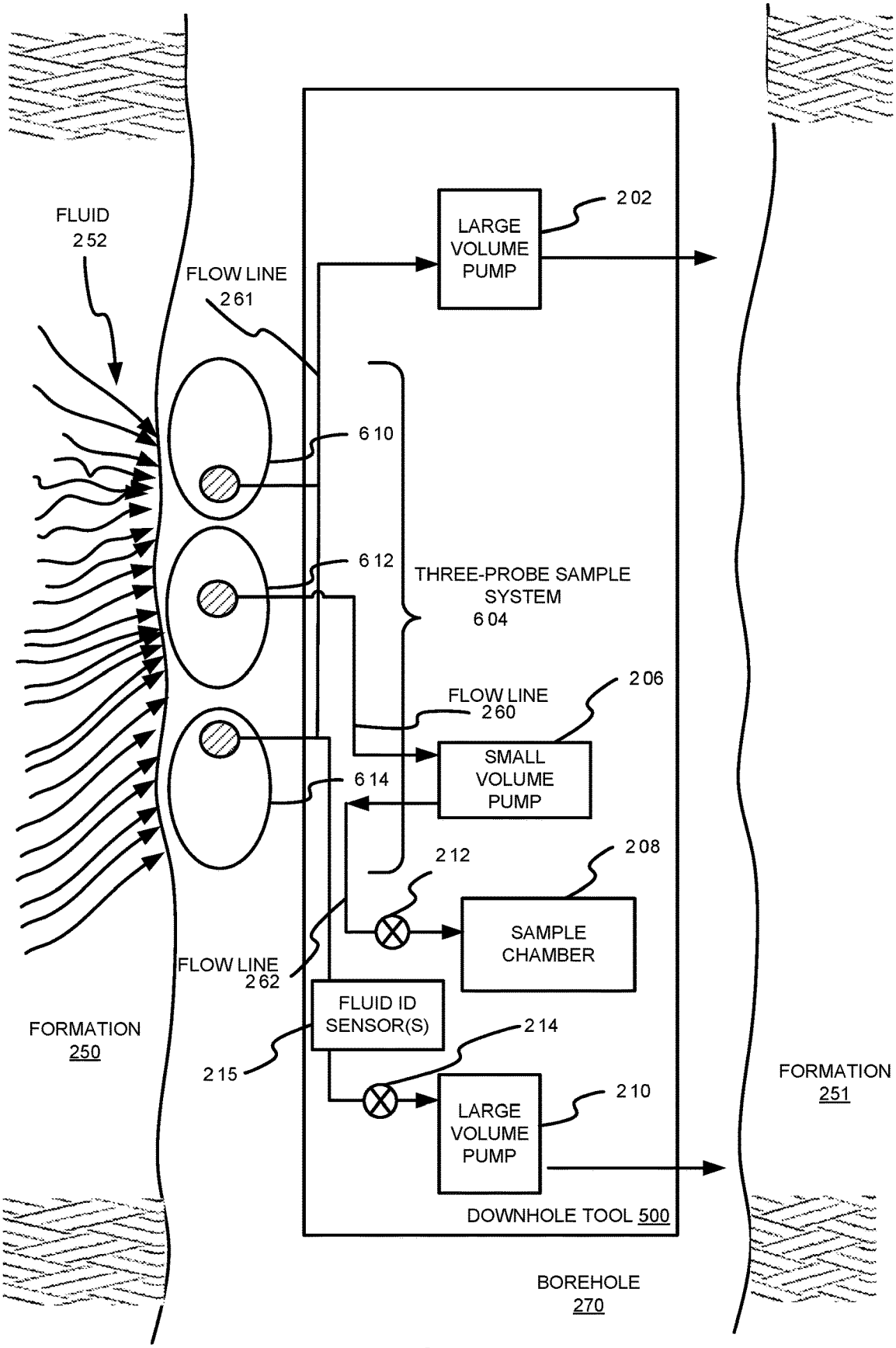
FIG. 6 depicts an illustrative downhole tool that includes a split flow three-probe system for sampling a reactive reservoir, according to some embodiments.

FIG. 6 depicts an illustrative downhole tool that includes a split flow three-probe system for sampling a reactive reservoir, according to some embodiments. The downhole tool of FIG. 6 is similar to the downhole tool of FIG. 2 but includes a three-probe system that is coupled to the flow lines of the downhole tool. As shown, FIG. 6 includes a downhole tool 600 having a juxtaposed probe system 604 that includes a probe 610, a probe 612, and a probe 614.

In this example, the center probe (the probe 612 is used to provide flow to the small volume pump 206 and the sample chamber 208. Thus, an inlet of the probe 612 is coupled to the flow line 260. The outside probes (the probe 610 and the probe 614) can be used to clean the reservoir from drilling fluid filtrate at a rapid rate with large volume pumps. Thus, an inlet of the probe 610 and the inlet of the probe 614 are coupled the flow line 261. While having a different probe configuration, operations of the downhole tool 500 are similar to operations of the downhole tool 200 of FIG. 2 to provide the split flow. The flow line 262 is coupled from an output of the small volume pump 206 to an input of the valve 212. However, in this example, the flow line 262 is not coupled to an input of the flow ID sensor(s) 215. Rather, the flow line 261 is coupled to the input of the flow ID sensor(s) 215. An output of the flow ID sensor(s) 215 is coupled to the input of the valve 214 (similar to the downhole tool 200 of FIG. 2. While having a different probe configuration and flow line connectivity, operations of the downhole tool 600 are similar to operations of the downhole tool 200 of FIG. 2 to provide the split flow.

Figure 7:
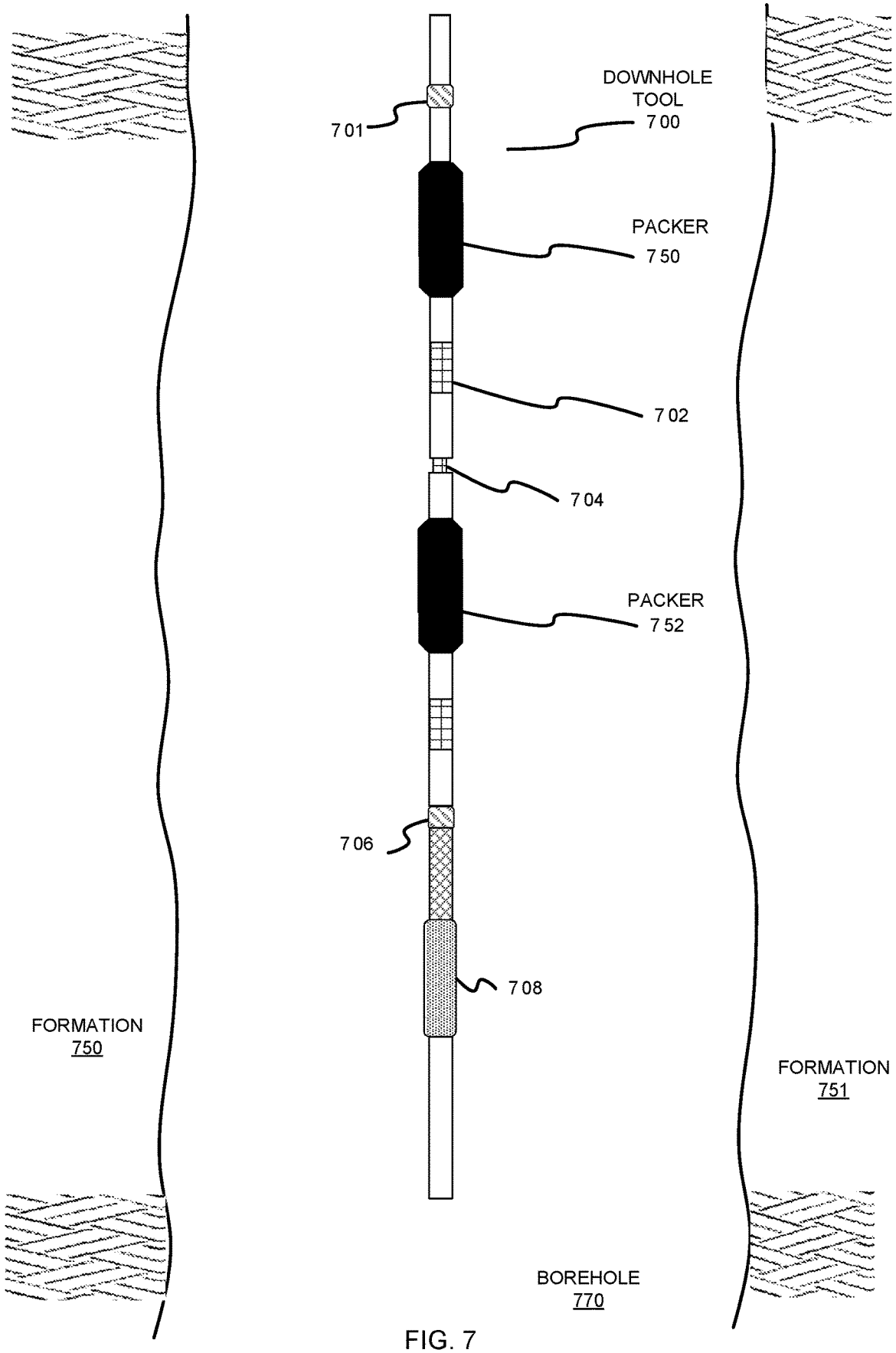
FIG. 7 depicts an illustrative downhole tool that includes a split flow packer system for sampling a reactive reservoir, according to some embodiments.

In some embodiments, a packer configuration can used for sampling instead of a probe. To illustrate, FIG. 7 depicts an illustrative downhole tool that includes a split flow packer system for sampling a reactive reservoir, according to some embodiments. FIG. 7 depicts a downhole tool 700 positioned in a borehole 770 with formations 750-751 surrounding the borehole. that includes a packer 750 and a packer 752 positioned below the packer 750. A bypass 701 is positioned above the packer 750. An upper inlet 702 and a lower inlet 704 are positioned between the packer 750 and the packer 752. The upper inlet is positioned above the lower inlet 704. A bypass 706 is positioned below the packer 752, and a sample valve 708 is positioned below the bypass 706.

In some embodiments, the lower inlet 704 can be coupled to a first flow line and configured to clean the reservoir from drilling fluid filtrate at a rapid rate with a large volume pump (as described above). The upper inlet 702 can be coupled to a second flow line and configured to sample the formation fluids (having reactive components) with a small volume pump (as described above).

Example Operations

Figure 8:
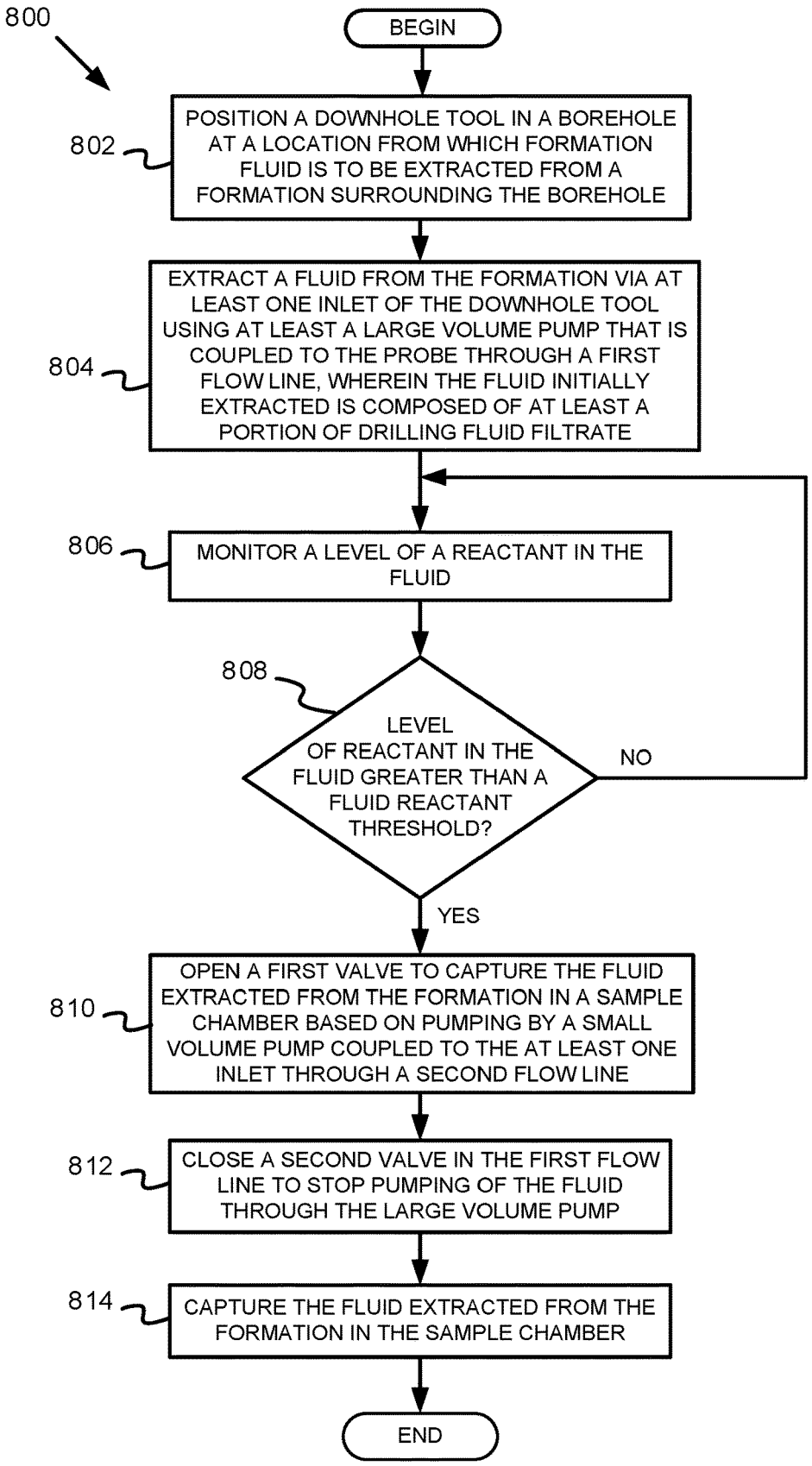
FIG. 8 depicts a flowchart of operations of sampling a reactive reservoir using a split flow probe, according to some embodiments.

FIG. 8 depicts a flowchart of operations of sampling a reactive reservoir using a split flow probe, according to some embodiments. Operations of a flowchart 800 are described with reference to the downhole tool 200 depicted in FIG. 2.

At block 802, a downhole tool is positioned in a borehole at a location from which formation fluid is to be extracted from a formation surrounding the borehole. For example, with reference to FIG. 2, the downhole tool 200 is positioned down the borehole 270 to extract formation fluid from the formation 250 for analysis.

At block 804, a fluid from the formation is extracted via at least one inlet of the downhole tool using at least a large volume pump that is coupled to the probe through a first flow line, wherein the fluid initially extracted is composed of at least a portion of drilling fluid filtrate. For example, with reference to FIG. 2, the fluid 252 is extracted from the formation 250.

At block 806, a level of a reactant in the fluid is monitored. For example, with reference to FIG. 2, the fluid ID sensor(s) 215 can monitor the level or concentration of one or more reactants in the fluid.

At block 808, a determination is made of whether the level of reactant in the fluid is greater than a fluid reactant threshold. For example, with reference to FIG. 2, a processor or controller in the downhole tool can determine whether the level or concentration of the one or more reactants in the fluid is greater than some percentage (e.g., 25%, 50%, 95%, etc.). If the level of reactant in the fluid is not greater than the fluid reactant threshold, operations of the flowchart 800 return to block 806 where monitoring continues. If the level of reactant in the fluid is greater than the fluid reactant threshold, operations of the flowchart 800 continue at block 810.

At block 810, a first valve is opened to capture the fluid extracted from the formation in a sample chamber based on pumping by a small volume pump coupled to the at least one inlet through a second flow line. For example, with reference to FIG. 2, the valve 212 is opened.

At block 812, a second valve is closed in the first flow line to stop pumping of the fluid through the large volume pump. For example, with reference to FIG. 2, the valve 214 is closed to stop pumping of the fluid through the large volume pump 210.

At block 814, the fluid extracted from the formation is captured in the sample chamber. For example, with reference to FIG. 2, the sample chamber 208 captures the fluid after the valve 212 is opened and the valve 214 is closed. Operations of the flowchart 800 are complete.

The flowchart is provided to aid in understanding the illustrations and are not to be used to limit scope of the claims. The flowchart depicts example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

While the aspects of the disclosure are described with reference to various implementations and exploitations, it will be understood that these aspects are illustrative and that the scope of the claims is not limited to them. In general, techniques for acid injection as described herein may be implemented with facilities consistent with any hardware system or hardware systems. Many variations, modifications, additions, and improvements are possible.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine readable signal medium or a machine readable storage medium. A machine readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine readable signal medium may be any machine readable medium that is not a machine readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

Example Computer

Figure 9:
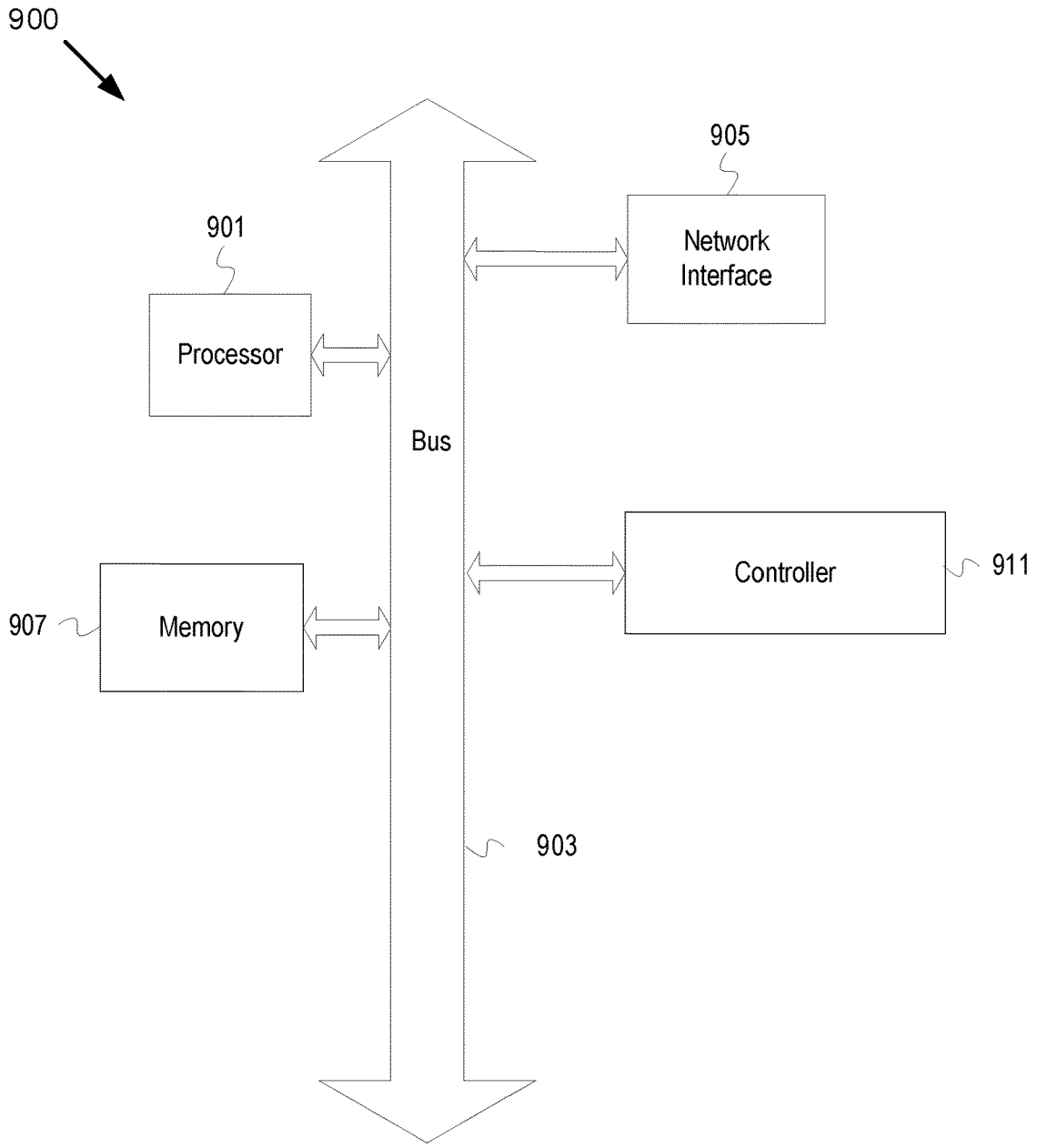
FIG. 9 depicts an example computer, according to some embodiments.

FIG. 9 depicts an example computer, according to some embodiments. A computer 900 of FIG. 9 includes a processor 901 (possibly including multiple processors, multiple cores, multiple nodes, and/or implementing multi-threading, etc.). The computer 900 includes a memory 907. The memory 907 may be system memory or any one or more of the above already described possible realizations of machine-readable media. The computer 900 also includes a bus 903 and a network interface 905. The computer 900 also includes a controller 911. The controller 911 may perform at least a portion of the operations as described in the flowchart of FIG. 8. Any one of the previously described functionalities may be partially (or entirely) implemented in hardware and/or on the processor 901. For example, the functionality may be implemented with an application specific integrated circuit, in logic implemented in the processor 901, in a co-processor on a peripheral device or card, etc. Further, realizations may include fewer or additional components not illustrated in FIG. 9 (e.g., video cards, audio cards, additional network interfaces, peripheral devices, etc.). The processor 901 and the network interface 905 are coupled to the bus 903. Although illustrated as being coupled to the bus 903, the memory 907 may be coupled to the processor 901.

While the aspects of the disclosure are described with reference to various implementations and exploitations, it will be understood that these aspects are illustrative and that the scope of the claims is not limited to them. In general, techniques for reservoir sampling as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Example Embodiments

A downhole tool comprising at least one inlet and a first pump coupled to the at least one inlet via a first flow line. The first pump is to pump at a first pump rate to extract fluid via the at least one inlet from a subsurface formation in which a borehole is created and in which the downhole tool is to be positioned. The downhole tool comprises a sample chamber coupled to the inlet via a second flow line, and a second pump coupled to the inlet via the second flow line. The second pump is to pump at a second pump rate to extract the fluid via the at least one inlet from the subsurface formation and for storage in the sample chamber. The first pump rate is greater than the second pump rate.

The at least one inlet comprises a probe.

The downhole tool further comprises a first valve coupled to the first flow line. A position of the first valve is changed from opened to closed to stop flow of the fluid through the first flow line after a level of a reactant in the fluid is greater than a fluid reactant threshold.

The first pump is at a first distance from the at least one inlet and the second pump is at a second distance from the at least one inlet. The first distance is greater than the second distance.

A diameter of the first flow line is greater than a diameter of the second flow line.

The second flow line is coated with a reactive component inert material.

The at least one inlet comprises a focused probe that includes a center probe and an outer guard probe.

The downhole tool further comprises a first packer and a second packer. The at least one inlet is positioned between the first packer and the second packer. The at least one inlet comprises a lower inlet and an upper inlet that is positioned above the lower inlet. The lower inlet is coupled to the first flow line and the upper inlet is coupled to the second flow line.

A method comprises positioning a downhole tool in a borehole at a location from which a fluid is to be extracted from a subsurface formation surrounding the borehole, extracting the fluid from the subsurface formation via at least one inlet of the downhole tool using a first pump that is coupled to the at least one inlet through a first flow line, wherein the fluid initially extracted is composed of at least a portion of drilling fluid filtrate, monitoring a level of a reactant in the fluid, and in response to determining that the level of the reactant in the fluid is greater than a fluid reactant threshold, closing a first valve in the first flow line to stop flow of the fluid through the first flow line, opening a second valve in a second flow line to enable flow of the fluid through the second flow line based on pumping by a second pump coupled to the at least one inlet through the second flow line, wherein a pump rate of the first pump is greater than a pump rate of the second pump, and capturing the fluid extracted from the subsurface formation and flowing through the second flow line in a sample chamber.

The at least one inlet comprises a probe.

The method further comprises, in response to determining that the level of the reactant in the fluid is greater than the fluid reactant threshold, activating the second pump.

A surface area of the first flow line is greater than a surface area of the second flow line.

A distance from the at least one inlet to the second pump is greater than a distance from the at least one inlet to the second pump.

A diameter of the first flow line is greater than a diameter of the second flow line. The at least one inlet comprises a focused probe that includes a center probe and an outer guard probe. Extracting the fluid from the subsurface formation via the at least one inlet comprises extracting the fluid from the center probe.

The method further comprises extracting a fluid from the outer guard probe and determining fluid properties by pulsing the fluid on the outer guard probe.

The downhole tool comprises a first packer and a second packer. The at least one inlet comprises a lower inlet and an upper inlet that are positioned between the first packer and the second packer. The upper inlet is positioned above the lower inlet. The lower inlet is coupled to the first flow line and the upper inlet is coupled to the second flow line.

A system comprises a downhole tool to be positioned in a borehole formed in a subsurface formation. The downhole tool comprises at least one inlet, a first flow line having a first valve, a first pump coupled to the at least one inlet via the first flow line, a second flow line having a second valve, a sample chamber coupled to the at least one inlet via the second flow line, and a second pump coupled to the at least one inlet via the second flow line. The system comprises a processor and a computer-readable medium having instructions stored thereon that are executable by the processor to cause the processor to activate the first pump to cause the first pump to extract at a first pump rate a fluid from the subsurface formation via the at least one inlet, monitor a level of a reactant in the fluid being extracted by the first pump, and, in response to determining that the level of the reactant in the fluid is greater than a fluid reactant threshold, close the first valve in the first flow line and open the second valve such that fluid being extracted by operation of the second pump at a second pump rate and from the subsurface formation via the at least one inlet is captured in the sample chamber through the second flow line.

A distance from the at least one inlet to the first pump is greater than a distance from the at least one inlet to the second pump.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

The invention claimed is:

1. A method comprising:

positioning a downhole tool in a borehole at a location from which a fluid is to be extracted from a subsurface formation surrounding the borehole;

extracting the fluid from the subsurface formation via at least one inlet of the downhole tool using a first pump that is coupled to the at least one inlet through a first flow line, wherein the fluid initially extracted is composed of at least a portion of drilling fluid filtrate;

monitoring a level of a reactant in the fluid; and in response to determining that the level of the reactant in the fluid is greater than a fluid reactant threshold, closing a first valve in the first flow line to stop flow of the fluid through the first flow line;

opening a second valve in a second flow line to enable flow of the fluid through the second flow line based on pumping by a second pump coupled to the at least one inlet through the second flow line, wherein a pump rate of the first pump is greater than a pump rate of the second pump; and capturing the fluid extracted from the subsurface formation and flowing through the second flow line in a sample chamber.

2. The method of claim 1, wherein the at least one inlet comprises a probe.

3. The method of claim 1, further comprising:

in response to determining that the level of the reactant in the fluid is greater than the fluid reactant threshold, activating the second pump.

4. The method of claim 1, wherein a surface area of the first flow line is greater than a surface area of the second flow line.

5. The method of claim 1, wherein a distance from the at least one inlet to the second pump is greater than a distance from the at least one inlet to the second pump.

6. The method of claim 1, wherein a diameter of the first flow line is greater than a diameter of the second flow line.

7. The method of claim 1, wherein the at least one inlet comprises a focused probe that includes a center probe and an outer guard probe, and wherein extracting the fluid from the subsurface formation via the at least one inlet comprises extracting the fluid from the center probe.

8. The method of claim 7, further comprising:

extracting a fluid from the outer guard probe; and determining fluid properties by pulsing the fluid on the outer guard probe.

9. The method of claim 1, further comprising:

wherein the downhole tool comprises a first packer and a second packer, wherein the at least one inlet comprises a lower inlet and an upper inlet that are positioned between the first packer and the second packer, wherein the upper inlet is positioned above the lower inlet, and wherein the lower inlet is coupled to the first flow line and the upper inlet is coupled to the second flow line.

10. A system comprising:

a downhole tool to be positioned in a borehole formed in a subsurface formation, the downhole tool comprising, at least one inlet;

a first flow line having a first valve;

a first pump coupled to the at least one inlet via the first flow line;

a second flow line having a second valve;

a sample chamber coupled to the at least one inlet via the second flow line; and a second pump coupled to the at least one inlet via the second flow line;

a processor; and a computer-readable medium having instructions stored thereon that are executable by the processor to cause the processor to, activate the first pump to cause the first pump to extract at a first pump rate a fluid from the subsurface formation via the at least one inlet;

monitor a level of a reactant in the fluid being extracted by the first pump; and in response to determining that the level of the reactant in the fluid is greater than a fluid reactant threshold, close the first valve in the first flow line; and open the second valve such that fluid being extracted by operation of the second pump at a second pump rate and from the subsurface formation via the at least one inlet is captured in the sample chamber through the second flow line.

11. The system of claim 10, wherein a distance from the at least one inlet to the first pump is greater than a distance from the at least one inlet to the second pump.

* * * * *